US006374432B1

(12) United States Patent
Morris

(10) Patent No.: US 6,374,432 B1
(45) Date of Patent: Apr. 23, 2002

(54) PORTABLE URINAL

(76) Inventor: Edwin E. Morris, 7111 Dogwood Creek La., Dallas, TX (US) 75252

( * ) Notice: Subject to any disclaimer, the term of this patent is extended or adjusted under 35 U.S.C. 154(b) by 0 days.

(21) Appl. No.: 09/702,243

(22) Filed: Oct. 31, 2000

(51) Int. Cl.[7] ..... A47K 11/12
(52) U.S. Cl. ..... 4/476; 4/144.1
(58) Field of Search ..... 4/144.1, 321, 323, 4/449, 459, 461, 462, 463, 476, 477, 599

(56) References Cited

U.S. PATENT DOCUMENTS 393,294 A * 11/1888 Carrico ..... 4/462
3,066,311 A * 12/1962 Tharp ..... 4/462
3,992,727 A * 11/1976 Elkins ..... 4/321 X
4,883,016 A * 11/1989 Larson ..... 4/449 X

* cited by examiner

*Primary Examiner*—Robert M. Fetsuga
(74) *Attorney, Agent, or Firm*—Michael A. O'Neil

(57) ABSTRACT

A portable urinal includes a receiving container which is secured against accidental overturning. A hollow support member extends upwardly from the receiving container. A urine receiver is mounted on the hollow support member and connected in fluid communication therewith. A curtain support fixture is mounted at the upper end of the support member and in turn supports a privacy curtain which extends entirely around the receiving container, the support member, and the urine receiver.

9 Claims, 3 Drawing Sheets

PORTABLE URINAL

TECHNICAL FIELD

This invention relates generally to transportable toilet facilities, and more particularly to a portable urinal which is readily disassembled for transport in a pickup truck or similar vehicle.

BACKGROUND AND SUMMARY OF THE INVENTION

Transportable toilets are now in widespread use. Many jurisdictions require contractors to provide transportable toilets at construction sites wherein large numbers of workers will be employed over a substantial period of time. Transportable toilets are also utilized at concerts and other large gatherings to supplement permanently installed toilet facilities.

Transportable toilets typically comprise an upright rectangular structure. A door is openable to provide access and closable to provide privacy. The device is entirely self-contained, and is removed from the location at which it is used whenever waste disposal is required.

Although transportable toilets are well suited for use at larger construction sites, concerts, etc., they are not well adapted for use in conjunction with smaller projects such as swimming pool construction, driveway and sidewalk construction, exterior painting of office buildings and residences, landscaping installation and maintenance, etc. It is simply uneconomical to deliver a transportable toilet to such a location and then to retrieve the portable toilet after a relatively short time and relatively little use.

Nevertheless, workers at job sites which do not justify the use of a transportable toilet need to periodically relieve themselves. Heretofore this has been accomplished either by leaving the site to visit a nearby service station or convenience store, or by finding a hopefully private location on the job site itself. Both solutions to the problem are obviously unsatisfactory.

The present invention comprises a portable urinal which overcomes the foregoing and other problems since associated with the prior art. In accordance with the broader aspects of the invention, a support tube extends upwardly from the receiving container and supports a privacy curtain which surrounds the receiving container. A urine receiver is mounted on the support tube and is connected in fluid communication therewith so that urine is directed from the receiver into the support tube and downwardly through the support tube into the receiving container.

The portable urinal of the present invention is typically disassembled for delivery to a job site. This is accomplished by removing the privacy curtain from the support tube and removing the support tube from the receiving container. Each of the component parts comprising the portable urinal is easily handled by a single individual without the requirement of mechanized lifting apparatus. The component parts of the portable urinal are easily received in and transported by a pickup truck or similar vehicle.

At the job site, the receiving container is removed from the transporting vehicle and positioned at a convenient location. The support tube is installed on the receiving container and the privacy curtain is mounted on the support tube. At this point the portable urinal is ready for use by workers at the job site.

In accordance with more specific aspects of the invention, the support tube may comprise two or more component parts which may be secured one to another by suitable clamping apparatus. The receiving container may be provided with ballast in the bottom thereof to prevent the portable urinal from being overturned due to high winds or engagement by personnel or machinery working at the job site. Alternatively, the receiving container may be positioned in a stabilizing frame to prevent overturning of the portable urinal.

BRIEF DESCRIPTION OF THE DRAWINGS

A more complete understanding of the present invention may be had by reference to the following Detailed Description when taken in connection with the accompanying Drawings wherein.

DETAILED DESCRIPTION

Figure 1:
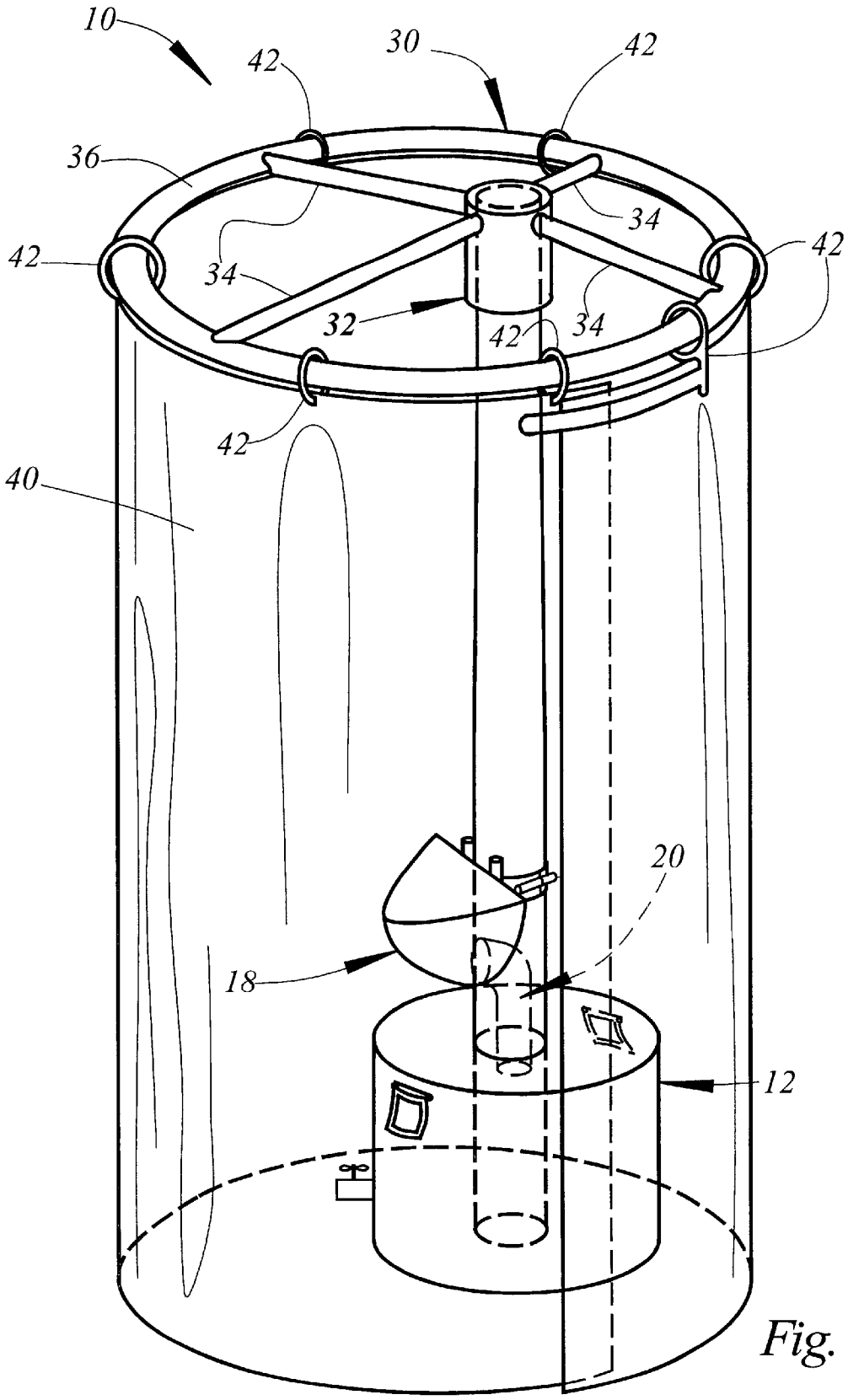
FIG. 1 is a perspective view of a portable urinal comprising a first embodiment of the invention.

Referring now to the Drawings, and particularly to FIG. 1 thereof, there is shown a portable urinal 10 incorporating a first embodiment of the invention. The portable urinal 10 includes a receiving container 12 which may be either drum shaped or rectangular in configuration depending upon the requirements of particular applications of the invention. A hollow support member 16 extends into the receiving container and upwardly therefrom. A urine receiver 18 is mounted on the hollow support member 16 and is connected in fluid communication therewith by an elbow 20. It will therefore be understood that urine received in the urine receiver 18 flows into the interior of the hollow support member 16 through the elbow 20 and from the hollow support member 16 into the receiving container 12 under the action of gravity.

Figure 2:
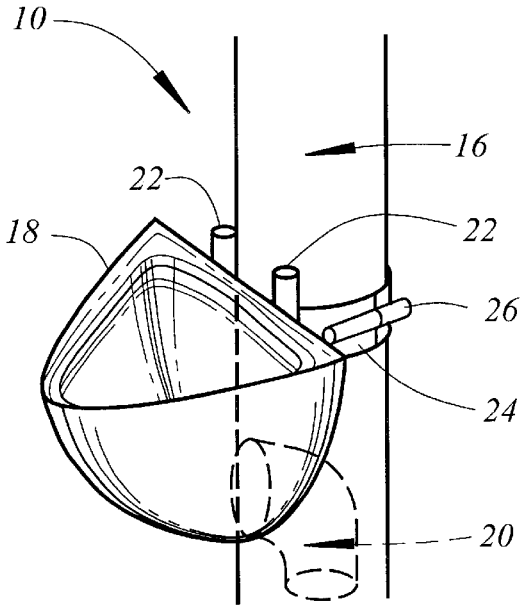
FIG. 2 is an enlargement of a portion of FIG. 1.

Referring to FIG. 2, the urine receiver 18 is provided with a pair of pins 22 which engage the hollow support member 16 to maintain the urine receiver 18 in alignment therewith. The urine receiver 18 is secured in engagement with the hollow support member 16 by a clamp 24 of the type utilized in automobile engines to secure hoses in place. The clamp 24 is provided with a screw-type actuator 26 which is conveniently operated by a screwdriver or a wrench.

Referring again to FIG. 1, the support member 16 extends upwardly beyond the receiver 18. A curtain support structure 30 is mounted at the upper end of the support member 16. The curtain support structure 30 includes a hub 32 which receives the upper end of the support member 16 whereby the support structure 30 is mounted on the support member 16. A plurality of arms 34 extend outwardly from the hub 32 and in turn support a ring 36. A privacy curtain 40 is slidedly supported on the ring 36 by a plurality of hangers 42 of the type utilized to slidedly support shower curtains. Although illustrated as transparent in FIG. 1, the privacy curtain 40 is actually opaque or nearly so, such that the features and the identity of a person utilizing the portable urinal 10 are entirely disguised.

The ring 36 is illustrated in FIG. 1 as being round in shape. In actual practice, however, the ring 36 may be round, oval, square, or rectangular. Likewise, four arms 34 are illustrated in FIG. 1. In actual practice however, the rings 36 may be supported on the hub 32 by one, two, three, four, or more arms depending upon the requirements of the particular applications of the invention. The hub 32 is preferably offset relative to the ring 36 so as to provide maximum space between the privacy curtain 40 and the urine receiver 18, and the minimum space between the privacy curtain 40 and the side of the support member 16 opposite the urine receiver 18. Other configurations of the hub 32 relative to the ring 36 may be utilized depending upon the requirements of particular applications of the invention.

Figure 3:
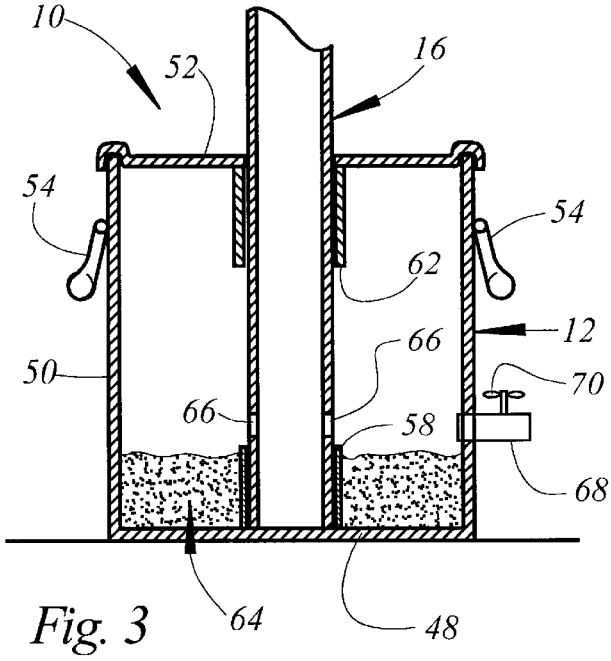
FIG. 3 is a partial sectional view of the portable urinal of FIG. 1.

Having reference to FIG. 3, the construction of the receiving container 12 and the lower portion of the support member 16 are shown in greater detail. The receiving container 12 is generally rectangular in vertical cross section and includes a bottom wall 48, one or more side walls 50, and a top wall 52. The top wall 52 may be releaseably or permanently secured in place, depending upon the requirements of particular applications of the invention. The receiving container 12 is preferably provided with handles 54 to facilitate the positioning of the portable urinal 10 for utilization at a job site, and thereafter to facilitate transportation of the portable urinal 10 to another location.

The bottom wall 48 and the top wall 52 are preferably provided with guides 58 and 62, respectively. The guides 58 and 62 receive the lower end of the support member 16 therein. The support member 16 may be permanently secured in the receiving container 12. Preferably, however, the support member 16 is releaseably secured in the receiving container 12 to facilitate disassembly of the portable urinal 10 for transport.

In one embodiment of the invention, the bottom portion of the receiving container 12 is provided with a quantity of ballast 64. The ballast 64 may comprise sand, gravel, metal filings, or similar dense materials. Alternatively, the ballasts 64 may comprise a quantity of solid material such as lead, iron, cement, etc. which is dimensioned to fit within the receiving container 12 and around the guides 58. The purpose of the ballast 64 is to prevent accidental tip over of the portable urinal 10 and in particular the receiving container 12 due to high winds or accidental contact by personnel or machinery.

The lower portion of the hollow support member 16 is provided with a plurality of drain holes 66. By this means urine received in the interior of the support member 16 from the urine receiver 18 through the elbow 20 and traveling downwardly within the interior of the hollow support member 16 under the action of gravity is discharged into the interior of the receiving container 12. The receiving container 12 may be provided with a discharge port 68 including a valve 70. Alternatively, the contents of the receiving container may be discharged through an opening formed in the top wall 52.

Figure 4:
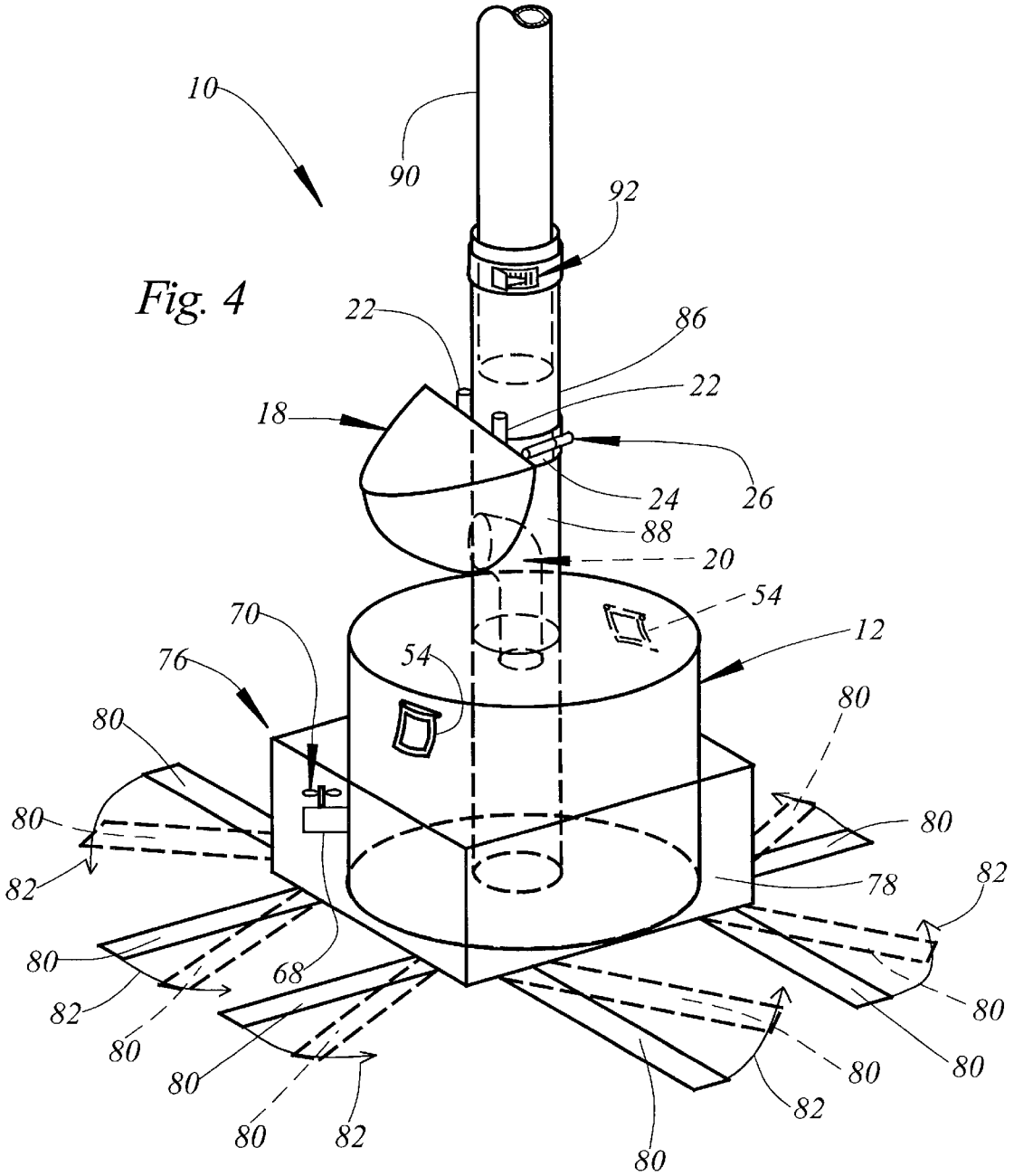
FIG. 4 is a partial perspective view of a portable urinal comprising a second embodiment of the invention.

Referring to FIG. 4, in lieu of the ballast 64, the receiving container 12 of the portable urinal 10 may be received in a support frame 76. The support frame 76 includes a container 78 which snugly receives the receiving container 12 therein. The support frame 76 further includes a plurality of legs 80 which are pivotally secured on the bottom of the container 78. When the portable urinal 10 is in use, the legs 80 of the support frame 76 extend perpendicularly outwardly from the four sides of the container 78 to provide maximum stabilization, thereby preventing overturning of the portable urinal 10 and in particularly the receiving container 12 due to high winds or accidental engagement by personnel or machinery on the job site. As is indicated by the arrows 82, each of the legs 80 is adapted for inward pivotal movement to facilitate storage and transport of the support frames 76 when the portable urinal 10 is not in use.

Figure 5:
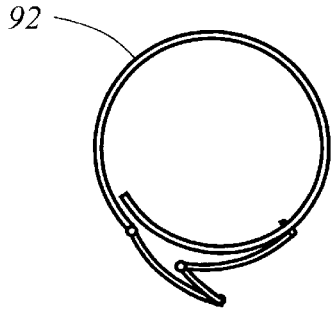
FIG. 5 is an illustration of a clamping apparatus useful in the practice of the invention.

FIG. 4 further illustrates a hollow support member 86 comprising a lower component 88 which extends into the receiving container 12 and an upper component 90 which is telescopingly received in the lower component 88. A clamp 92 is utilized to secure the upper component 90 of the hollow support member 86 relative to the lower component 88 thereof. As is best shown in FIG. 5, the clamp 92 preferably comprises an over-center or toggle type clamp of the kind commonly utilized in packaging and similar applications. The clamp 92 may also comprise a compression fitting of the type commonly utilized to secure the ends of adjacent sections of thin wall metal pipe and plastic pipe one to another. Clamping apparatus such as the clamp 24 illustrated in FIG. 2 and the clamp 92 illustrated in FIG. 5 may also be utilized to secure the tubular support member of the portable urinal 10 to the receiving container 12 and/or to secure the curtain support member to the upper end of the support member, depending upon the requirements of particular applications of the invention.

The hollow support member construction of FIG. 4 may also comprise a lower section secured in the receiving container, a middle section secured to the lower section by a suitable clamp and having the urine receiver mounted thereon, and an upper section secured to the middle section by a suitable clamp.

Figure 6:
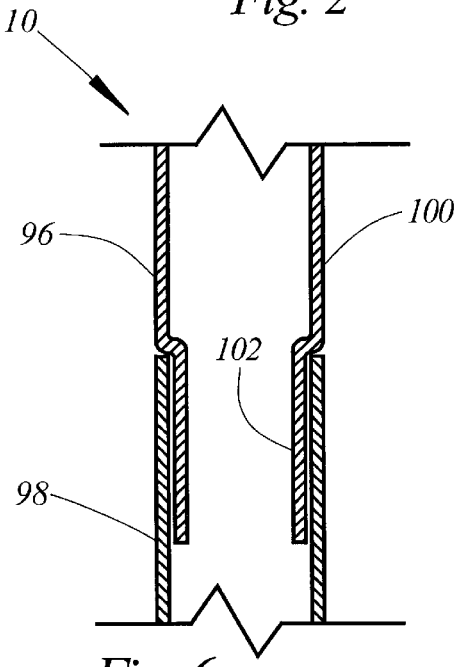
FIG. 6 is a sectional view illustrating a support member construction useful in the practice of the invention.

FIG. 6 illustrates a hollow support member 96 which may be utilized in the portable urinal 10 in lieu of the hollow support member 16 of FIG. 1 and the multiple component hollow support member 86 of FIG. 4 and the clamps thereof. The hollow support member 96 includes at least a lower component 98 and an upper component 100 and may comprise three or more components. The upper component 100 includes a reduced diameter lower end 102 which is slidedly received in the upper end of the lower component 98. In this manner, the upper component 100 and the lower component 98 of the hollow tubular support 96 are retained in engagement under the action of gravity. Such construction may be preferable in those applications of the invention which do not require the security of a clamping apparatus to retain the component parts of a multi-component hollow support member in engagement with one another.

The component parts of the portable urinal of the present invention may be manufactured from a variety of materials all of which are well known in the art. For example, the receiving container of the portable urinal can be manufactured from a variety of plastic materials including fiberglass, polyvinyl chloride, etc. The hollow support member and the curtain support structure can be manufactured from commercially available plastic pipe fabricated from polyvinyl chloride, polyethylene, etc. The various component parts of the portable urinal can also be manufactured from various metals, particularly including stainless steel and aluminum.

Although preferred embodiments of the invention have been illustrated in the accompanying Drawings and described in the foregoing Detailed Description, it will be understood that the invention is not limited to the embodiments disclosed but is capable of numerous rearrangements, modifications, and substitutions of parts and elements without departing from the spirit of the invention.

What is claimed is:

1. A portable urinal comprising:

a receiving container;

a hollow support member connected in fluid communication with the receiving container and extending upwardly therefrom;

a urine receiver mounted on the support member and connected in fluid communication with the interior thereof for receiving urine and for directing the received urine into the interior of the support member and downwardly therethrough into the receiving container;

a curtain support fixture mounted at the upper end of the support member; and a privacy curtain supported on and depending from the curtain support fixture, the privacy curtain extending substantially the entire length of the support member and substantially surrounding the receiving container, the support member and the urine receiver.

2. The portable urinal according to claim 1 wherein the receiving container has upper and lower ends and further including guide members mounted at the upper and lower ends of the receiving container for positioning the support member relative to the receiving container.

3. The portable urinal according to claim 2 wherein the guide members releaseably position the support member within the receiving container.

4. The portable urinal according to claim 1 wherein the support member comprises upper and lower portions, and further including connection means for releaseably securing the upper and lower components of the support member one to another.

5. The portable urinal according to claim 1 further characterized by means for preventing accidental overturning of the receiving container.

6. The portable urinal according to claim 5 wherein the means for preventing accidental overturning of the receiving container comprises a quantity of ballast positioned in the bottom of the receiving container.

7. The portable urinal according to claim 5 wherein the means for preventing accidental overturning of the receiving container comprises a support frame having legs extending in mutually perpendicular directions for normally containing the receiving container and preventing accidental overturning thereof.

8. The portable urinal according to claim 1 wherein the curtain support fixture comprises a hub for receiving the upper end of the support member and a curtain support ring mounted on the hub, and wherein the privacy curtain is slidedly supported upon the curtain support ring.

9. The portable urinal according to claim 1 wherein:

the receiving container has upper and lower ends and further including guide members mounted in the upper and lower ends of the receiving container for releaseably receiving the support member therein and for positioning the support member relative to the receiving container;

the receiving container is provided with means for preventing accidental overturning thereof; and the curtain support fixture includes a hub releaseably mounted at the upper end of the support member and a curtain support ring mounted on the hub and having the privacy curtain slidedly supported thereon.

* * * * *